US010717129B2

(12) United States Patent
Cook, III et al.

(10) Patent No.: US 10,717,129 B2
(45) Date of Patent: Jul. 21, 2020

(54) PRE-DIFFUSED MANDREL COATING TO PROVIDE ENHANCED BONDING BETWEEN METALLIC AND COMPOSITE COMPONENTS

(71) Applicant: HALLIBURTON ENERGY SERVICES, INC., Houston, TX (US)

(72) Inventors: Grant O. Cook, III, Spring, TX (US); Jeff G. Thomas, Magnolia, TX (US); Daniel B. Voglewede, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 160 days.

(21) Appl. No.: 15/579,171

(22) PCT Filed: Jun. 23, 2015

(86) PCT No.: PCT/US2015/037218
§ 371 (c)(1),
(2) Date: Dec. 1, 2017

(87) PCT Pub. No.: WO2016/209215
PCT Pub. Date: Dec. 29, 2016

(65) Prior Publication Data

US 2018/0133802 A1 May 17, 2018

(51) Int. Cl.
*B22F 5/00* (2006.01)
*B22F 7/06* (2006.01)
(Continued)

(52) U.S. Cl.
CPC ..... *B22F 5/00* (2013.01); *B22F 7/062* (2013.01); *C22C 1/1036* (2013.01); *E21B 10/42* (2013.01);
(Continued)

(58) Field of Classification Search
CPC ..... B22F 5/00; B22F 7/062; B22F 2005/001; B22F 2302/10; E21B 10/42; E21B 10/46; E21B 10/60
See application file for complete search history.

(56) References Cited

U.S. PATENT DOCUMENTS 4,720,371 A 1/1988 Shirley
6,089,123 A 7/2000 Chow et al.
(Continued)

FOREIGN PATENT DOCUMENTS

CN 1039749 A 2/1990
CN 103492662 A 1/2014
(Continued)

OTHER PUBLICATIONS

China National Intellectual Property Administration, First Office Action and Search Report , Application No. 201580080021.1, dated Nov. 29, 2018, 9 pages, China.
(Continued)

*Primary Examiner* — Hwei-Siu C Payer

(57) ABSTRACT

Drill bits and associated methods of manufacture and use employ a pre-diffused mandrel bonded to a composite metal-matrix material. The pre-diffused mandrel includes a chemically altered surface composition that enhances the bond with the composite metal-matrix component formed by infiltrating a metal-matrix component with a binder. The chemically altered surface may be configured to reduce binder-rich zones adjacent the mandrel, mechanically interlock the with the composite metal-matrix component or prevent the formation of brittle intermetallic particles along the bond.

19 Claims, 9 Drawing Sheets

(51) Int. Cl.

| | |
|---|---|
| ***E21B 10/46*** | (2006.01) |
| ***E21B 10/42*** | (2006.01) |
| ***C22C 1/10*** | (2006.01) |
| *C22C 29/06* | (2006.01) |
| *E21B 10/60* | (2006.01) |

(52) U.S. Cl.
CPC ..... *E21B 10/46* (2013.01); *B22F 2005/001* (2013.01); *B22F 2302/10* (2013.01); *C22C 29/06* (2013.01); *E21B 10/60* (2013.01)

(56) References Cited

U.S. PATENT DOCUMENTS

| | | | | |
|---|---|---|---|---|
| 6,148,936 | A | 11/2000 | Evans et al. | |
| 7,395,884 | B2 | 7/2008 | Kembaiyan et al. | |
| 7,827,883 | B1 * | 11/2010 | Cherng | B23K 26/34 76/107.8 |
| 8,973,683 | B2 | 3/2015 | Cuillier De Maindreville et al. | |
| 2002/0093606 | A1 | 7/2002 | Butcher et al. | |
| 2014/0131115 | A1 | 5/2014 | Thigpen et al. | |
| 2014/0284113 | A1 * | 9/2014 | Smith | E21B 10/42 175/327 |
| 2014/0374171 | A1 | 12/2014 | Thomas | |
| 2018/0133802 | A1 * | 5/2018 | Cook, III | E21B 10/42 |

FOREIGN PATENT DOCUMENTS

| | | |
|---|---|---|
| CN | 107635699 A | 1/2018 |
| GB | 2427619 A | 3/2007 |

OTHER PUBLICATIONS

China National Intellectual Property Administration, Notice on the First Office Action & Search Report, 201580080021.1, dated Nov. 29, 2018, 7 pages, English Translation, China.

Korean Intellectual Property Office, International Search Report and Written Opinion, dated Mar. 8, 2016, 16 pages, Korea.

* cited by examiner

PRE-DIFFUSED MANDREL COATING TO PROVIDE ENHANCED BONDING BETWEEN METALLIC AND COMPOSITE COMPONENTS

CROSS-REFERENCE TO RELATED APPLICATIONS

This application is a U.S. national stage patent application of International Patent Application No. PCT/US2015/037218, filed on Jun. 23, 2015 the benefit of which is claimed and the disclosure of which is incorporated herein by reference in its entirety.

BACKGROUND

1. Field of the Invention

The present disclosure relates generally to downhole tools such as drill bits useful in operations related to oil and gas exploration, drilling and production. More particularly, embodiments of the disclosure relate to tools, systems and methods related to drill bits constructed of a metal-matrix composite (MMC) bonded to a metallic mandrel.

2. Background

Often in operations for the exploration, drilling and production of hydrocarbons, water, geothermal energy or other subterranean resources, a rotary drill bit is used to form a wellbore through a geologic formation. Rotary drill bits generally include rotary-cone or roller-cone drill bits and fixed-cutter or drag bits. Fixed-cutter drill bits are often formed with a bit body having cutting elements or inserts disposed at select locations for engaging the geologic formation. The bit body is often constructed of a metal-matrix composite, and thus such fixed-cutter drill bits may sometimes be referred to as "matrix drill bits."

Manufacturing processes for matrix drill bits typically include forming a mold cavity in a block of material such as graphite. The mold cavity may be machined to have a negative profile of desired exterior features of the drill bit. Other features of the drill bit such as blades, cutter pockets, and/or fluid flow passageways, may be provided by shaping the mold cavity and/or by positioning temporary displacement material within the mold cavity. A pre-formed metallic mandrel may be placed within the mold cavity to provide reinforcement for the matrix bit body and to facilitate attachment of the resulting matrix bit body with a metal shank having a drill string connector thereon. Once the mold is formed, a quantity of loose reinforcement material or a metal-matrix component such as a tungsten carbide powder may be placed into the mold cavity. To form the metal-matrix composite, the metal-matrix component may then be infiltrated with a binder such as a molten copper alloy. A matrix bit body is formed after solidification of the binder with the metal-matrix component.

It has been observed that structural failure of a drill bit may occur at the bond formed between the mandrel and the metal-matrix composite in some instances. Accordingly, improvements of the bond may be warranted.

BRIEF DESCRIPTION OF THE DRAWINGS

The disclosure is described in detail hereinafter on the basis of embodiments represented in the accompanying figures, in which.

DETAILED DESCRIPTION

Figure 1:
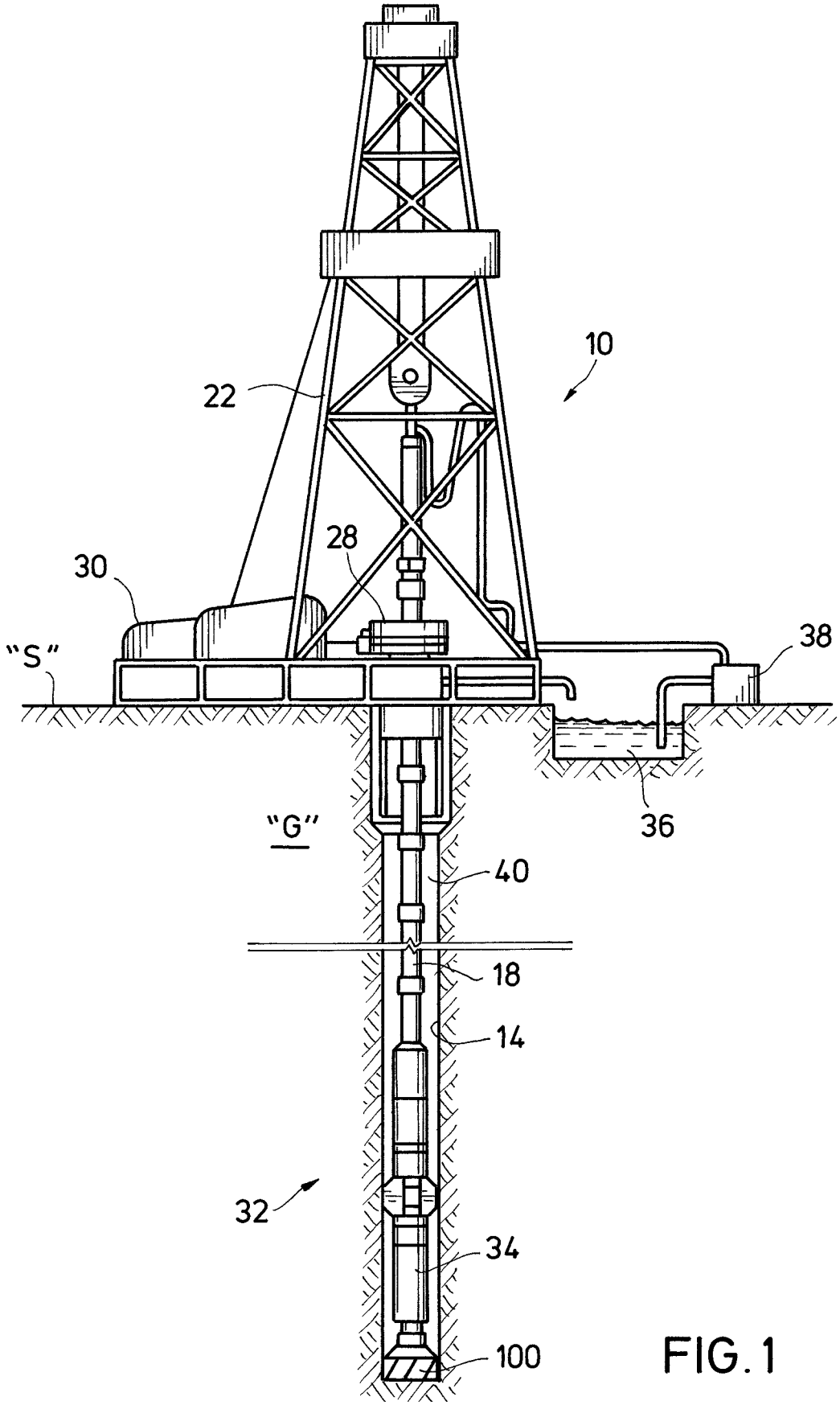
FIG. 1 is an elevation view of an example of a drilling system that may incorporate a matrix drill bit constructed in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a wellbore in a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depict a terrestrial operation, it should be understood by those skilled in the art that the apparatus according to the present disclosure is equally well suited for use in offshore operations. Further, unless otherwise noted, even though a Figure may depict an open-hole operation, it should be understood by those skilled in the art that the apparatus according to the present disclosure is equally well suited for use in cased-hole operations.

1. Description of Exemplary Embodiments

The present disclosure includes methods and apparatuses that may avoid the occurrence of chemical interactions between the metallic mandrel, the binder and/or the metal-matrix component during the manufacture of a drill bit, to maintain the strength of the bond formed between the mandrel and the metal-matrix composite. In particular, the disclosed methods and apparatuses may avoid the formation of brittle intermetallic particles along the bond line, and avoid binder-rich zones with low concentrations of the reinforcing metal-matrix component adjacent the mandrel. In some of the exemplary embodiments described below, methods are described for manufacturing a drill bit that include chemically altering a surface of the mandrel prior to loading the mandrel into a mold for forming the drill bit. When a metal matrix component is infiltrated with a binder in the mold, the chemically altered surface may improve the strength of the bond, e.g., by discouraging the formation brittle intermetallic particles and/or by macroscopically altering a surface texture of the mandrel to facilitate interlocking of the mandrel with the metal-matrix composite.

FIG. 1 is an elevation view of an example of a drilling system 10 that may incorporate a matrix drill bit 100 constructed in accordance with one or more exemplary embodiments of the disclosure. The drilling system 10 is partially disposed within a wellbore 14 extending from a surface location "S" and traversing a geologic formation "G." In the illustrated example, the wellbore 14 is shown generally vertical, though it will be understood that the wellbore 14 may include any of a wide variety of vertical, directional, deviated, slanted and/or horizontal portions therein, and may extend along any trajectory through the geologic formation "G."

The rotary drill bit 100 is provided at a lower end of a drill string 18 for cutting into the geologic formation "G." When rotated, the rotary drill bit 100 operates to break up and generally disintegrate the geological formation "G." The rotary drill bit 100 may be rotated in any of a variety of ways. In this example, at the surface location "S" a drilling rig 22 includes a turntable 28 that may be operated to rotate the entire drill string 18 and the rotary drill bit 100 coupled to the lower end of the drill string 18. The turntable 28 is selectively driven by an engine 30, chain-drive system, or other apparatus. In some embodiments, a bottom hole assembly or BHA 32 provided in the drill string 18 may include a downhole motor 34 to selectively rotate the drill bit 100 with respect to the rest of the drill string 18. The motor 34 may generate torque in response to the circulation of a drilling fluid, such as mud 36, therethrough. As those skilled in the art will recognize, the ability to selectively rotate the rotary drill bit 100 relative to the drill string 18 may be useful in directional drilling, and/or for other operations as well.

The mud 36 can be pumped downhole by mud pump 38 through an interior of the drill string 18. The mud 36 passes through the downhole motor 34 of the BHA 32 where energy is extracted from the mud 36 to turn the rotary drill bit 100. As the mud 36 passes through the BHA 32, the mud 36 may lubricate bearings (not explicitly shown) defined therein before being expelled through nozzles 124 (FIG. 2) defined in the rotary drill bit 100. The mud 36 flushes geologic cuttings and/or other debris from the path of the rotary drill bit 100 as it continues to circulate back up through an annulus 40 defined between the drill string 18 and the geologic formation "G." The geologic cuttings and other debris are carried by the mud 36 to the surface location "S" where the cuttings and debris can be removed from the mud stream.

Figure 2:
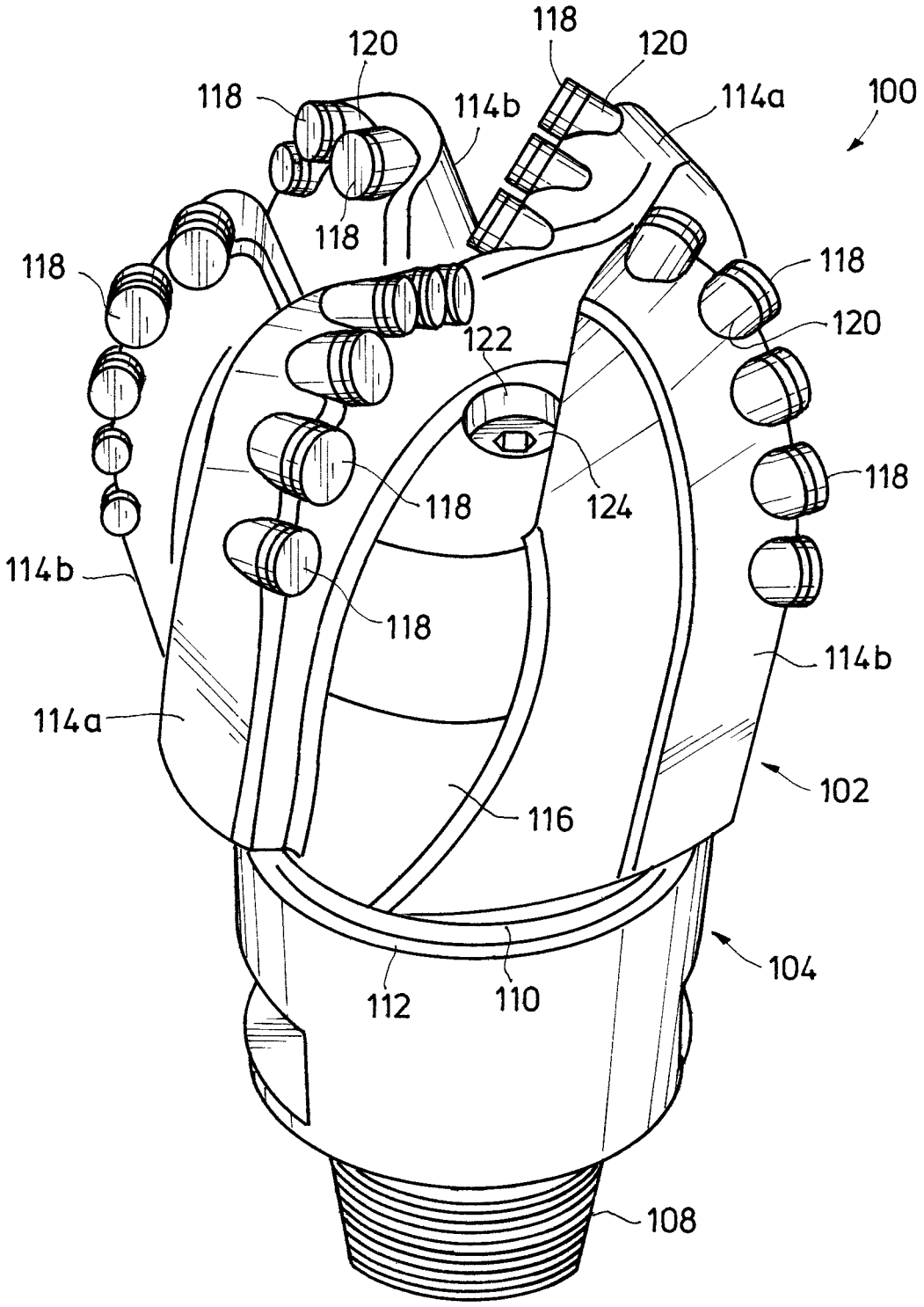
FIG. 2 is a perspective view of the matrix drill bit of FIG. 1 illustrating a matrix bit body thereof.

FIG. 2 is a perspective view of the rotary drill bit 100 illustrating a matrix bit body 102 thereof. For embodiments such as shown in FIG. 1, matrix rotary drill bit 100 may include a metal shank 104 fixed to the composite matrix bit body 102. Metal shank 104 may have a hollow, generally cylindrical configuration, e.g., to permit mud flow from the drill string 18 (FIG. 1) to interior portions of the rotary drill bit 100. Various types of connectors 108 may be defined on the metal shank 104 for coupling the rotary drill bit 100 to the drill string 18 (FIG. 1). In some exemplary embodiments, the connector 108 may include a threaded pin with American Petroleum Institute (API) threads defined thereon.

In some exemplary embodiments, the matrix bit body 102 is coupled to the metal shank 104 by a mandrel 110. The metal shank 104 and the mandrel 110 may be constructed of low-carbon steel or any of various metal alloys generally associated with manufacturing rotary drill bits. The mandrel 110 may be secured to the metal shank 104 by an annular weld 112, or by other various coupling mechanisms recognized in the art. The mandrel 110 extends into the matrix bit body 102, and is bonded thereto along a pre-diffused bonding location as described in greater detail below. As used herein, the term pre-diffused means at least that a diffusant chemically alters a surface composition of a mandrel prior to infiltrating a metal-matrix component to form a matrix bit body bond with the mandrel.

The matrix bit body 102 includes a plurality of cutting blades 114*a*, 114*b* circumferentially disposed about the rotary drill bit 100. Primary cutting blade 114*a* extends generally across a central portion of the matrix bit body 102 to two lateral sides thereof, and secondary cutting blades 114*b* are circumferentially interposed therebetween. Junk slots 116 are defined between the cutting blades 114*a*, 114*b*, and facilitate the removal of geologic materials and debris from the path of the rotary drill bit 100.

The cutting blades 114*a*, 114*b* support a plurality of cutting elements 118 in recesses or pockets 120 defined in the matrix bit body 102. The cutting elements 118 may be securely mounted the pockets 120 by brazing or other manufacturing techniques recognized in the art. The cutting elements 118 engage and remove adjacent portions of the geologic formation "G" (FIG. 1). The cutting elements 118 may scrape, shear, crush, gouge or otherwise break geologic materials from the bottom and sides of a wellbore 14 (FIG. 1) as the rotary drill bit 100 rotates downhole. In some exemplary embodiments, the cutting elements 118 may include various types of polycrystalline diamond compact (PDC) cutter components. A rotary drill bit including such PDC cutters may sometimes be referred to as a "PDC bit".

A plurality of nozzle openings 122 are defined in the matrix bit body 102 in one or more exemplary embodiments. Respective nozzles 124 may be disposed in each nozzle opening 122 for expelling various types of drilling fluid or mud 36 (FIG. 1) pumped through the drill string 18 (FIG. 1).

Figure 3:
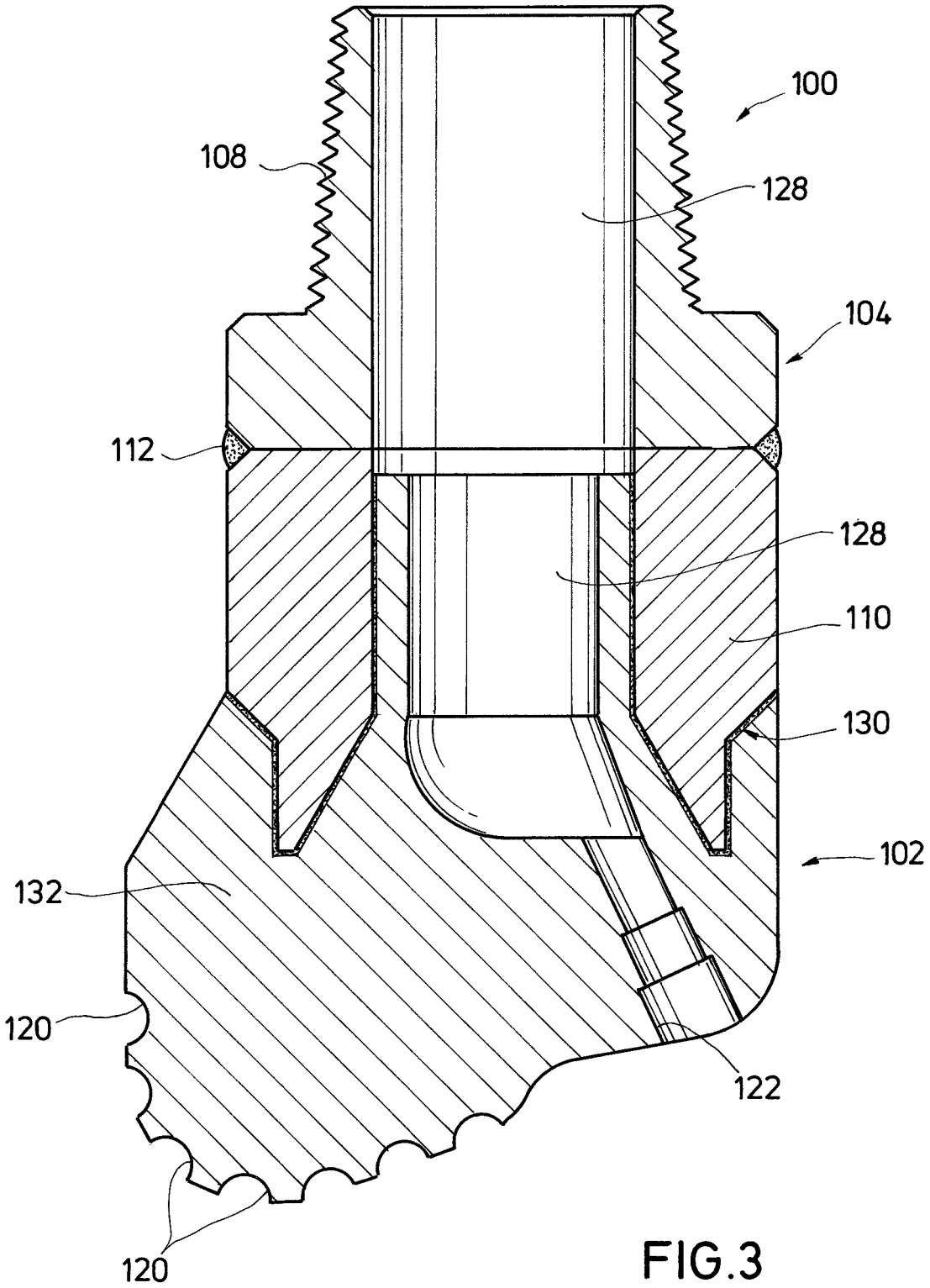
FIG. 3 is a cross-sectional view of the matrix drill bit of FIG. 2 illustrating a metallic mandrel bonded to the matrix bit body.

FIG. 3 is a partial, cross-sectional view of the drill bit 100 illustrating the metallic mandrel 110 bonded to the matrix bit body 102. As illustrated in in the cross-section of FIG. 3, the nozzle openings 122 are fluidly coupled to a fluid passageway 128 extending through the rotary drill bit 100. The fluid passageway 128 extends through the matrix bit body 102, the mandrel 110, and metal shank 104 coupled thereto by annular weld 112.

Also illustrated in FIG. 3, the mandrel 110 defines a bonding location 130 thereon across which the mandrel 110 is bonded to at least one matrix material such as metal-matrix composite 132 of the matrix bit body 102. As described in greater detail below, at least a portion of the bonding location 130 is pre-defused such that a base material of the mandrel 110 is chemically altered prior to bonding the mandrel 110 to the metal-matrix composite 132. The bond at the pre-diffused bonding location 130 may be formed as the metal-matrix composite 132 cools and hardens around the mandrel 110 as described below.

Figure 4:
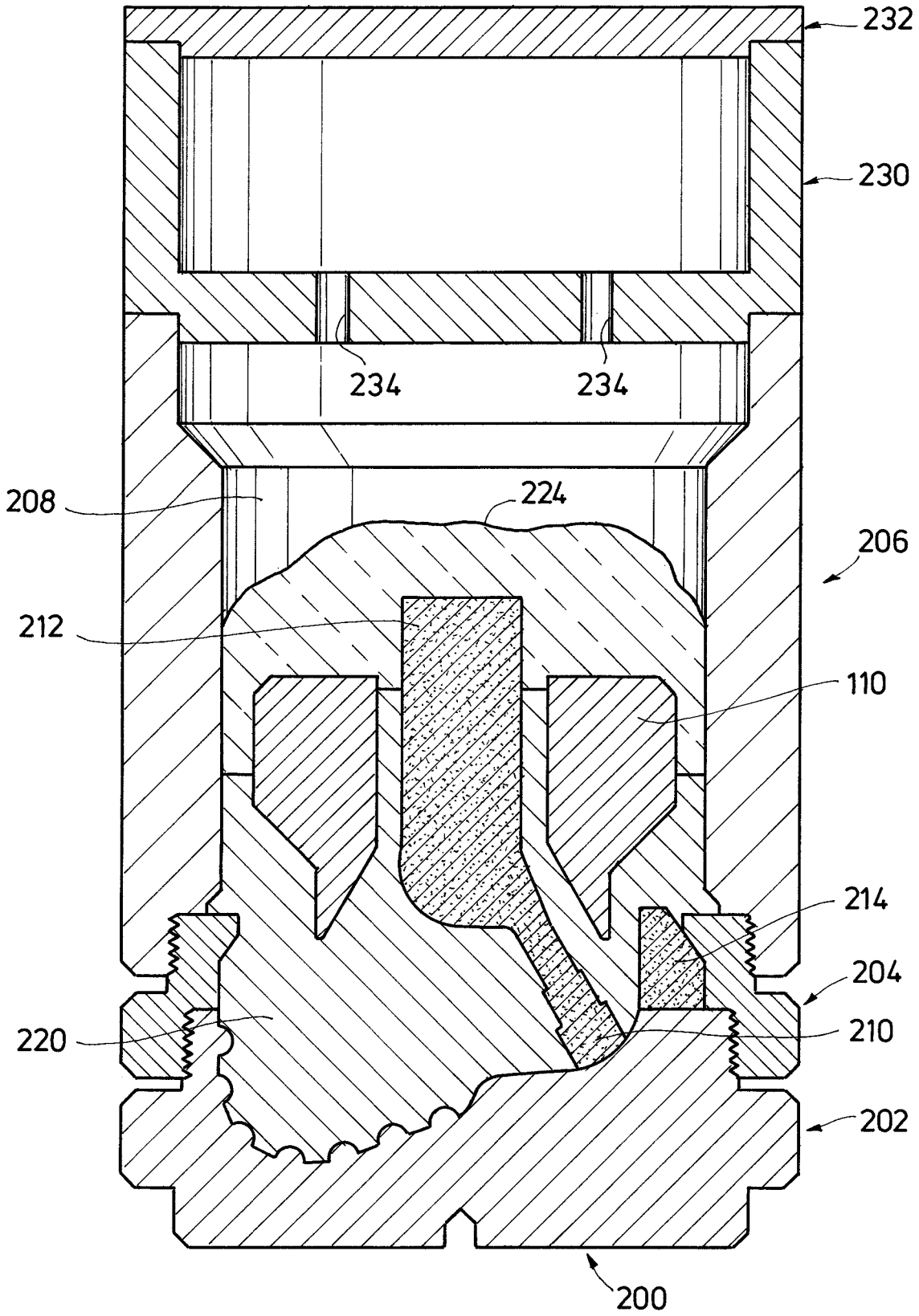
FIG. 4 a cross-sectional view of a mold assembly useful in forming the matrix bit body and bonding the matrix bit body to the metallic mandrel of FIG. 3.

FIG. 4 is a cross-sectional view of a mold assembly 200 useful in forming the matrix bit body 102 (FIG. 3) and bonding the matrix bit body 102 to the metallic mandrel 110. The mold assembly 200 includes a mold 202, connector ring 204 and a funnel 206, which together define a negative profile that corresponds to an exterior profile of at least a portion of the bit body 102. The mold 202, connector ring 204 and funnel 206 may be constructed from graphite or other material that may be readily removed from the bit body 102 once formed. Various techniques may be used including, but not limited to, machining a block of graphite to produce a mold cavity 208 within the mold assembly 200. The cavity may, e.g., define a negative profile of exterior features of the bit body 102 such as the cutter blades 114*a*, 114*b* (FIG. 2), junk slots 116 (FIG. 2) and pockets 120 (FIG. 2).

Various types of temporary displacement inserts may be installed within mold cavity 208, to facilitate the formation of interior, or partially interior features of the desired bit body 102 (FIG. 3). For example, the nozzle openings 122 (FIG. 3) and portions of the fluid passageway 128 (FIG. 3) may correspond to displacement inserts 210, 212, respectively. A displacement insert 214 may be provided within the mold cavity 208 adjacent the mold 202 and/or connector ring 204 to facilitate an undercut or some other feature that may be difficult to machine or otherwise form once the bit body 102 is formed. In some exemplary embodiments, the displacement inserts 210, 212 and 214 may be constructed of various configurations of consolidated sand, resins and/or graphite.

At least one reinforcement material or matrix component such as metal-matrix component 220 may be placed in the mold cavity 208, between the pre-diffused mandrel 110 and the displacement inserts 210, 212, 214. In some exemplary embodiments, the metal matrix component 220 may include tungsten carbide particles or powders that may include grains of monotungsten carbide, ditungsten carbide, and/or macrocrystalline tungsten carbide. Spherical cast tungsten carbide may be formed with no binding material. In other exemplary embodiments, the metal-matrix component 220 may include cemented carbides. As used herein, the term cemented carbide may include WC (tungsten carbide), MoC, TiC, TaC, NbC, $Cr_3C_2$, VC and solid solutions of mixed carbides such as WC—TiC, WC—TiC—TaC, WC—TiC—(Ta,Nb)C in a metallic binder (matrix) phase. Cemented carbides may be generally described as powdered refractory carbides which have been united by compression and heat with binder materials such as powdered cobalt, iron, nickel, molybdenum and/or their alloys. Cemented carbides may also be sintered, crushed, screened and/or further processed as appropriate. Cemented carbides may sometimes be referred to as "composite" carbides or sintered carbides. Some cemented carbides may also be referred to as spherical carbides. However, cemented carbides may have many configurations and shapes other than spherical.

To form the metal-matrix composite 132 (FIG. 3), the matrix metal-matrix component 220 is infiltrated with a binder 224. The binder 224 may include, but is not limited to, material such as copper (Cu), nickel (Ni), cobalt (Co), iron (Fe), aluminum (Al), molybdenum (Mo), chromium (Cr), manganese (Mn), tin (Sn), zinc (Zn), lead (Pb), silicon (Si), tungsten (W), boron (B), phosphorous (P), gold (Au), silver (Ag), palladium (Pd), indium (In), any combination thereof, or alloys based on these metals. The binder 224 provides ductility and toughness which often results in greater resistance to fracture (toughness) of the resulting bit body 102 (FIG. 3). Although the binder 224 is illustrated in FIG. 4 as being disposed above the metal-matrix component 220 with no intermixing therebetween for clarity, one skilled in the art will appreciate that the binder 224 may not remain entirely separate from the metal-matrix component 220 before the infiltrating or flowing into the metal-matrix component 220 to some degree.

In some exemplary embodiments, the mold assembly 200 may include a binder bowl 230 with a lid or cap 232 coupled above the funnel 206. The binder 224 may be stored in the binder bowl 230 prior to infiltrating the metal-matrix component 220, and apertures 234 defined in a lower portion of the binder bowl 230 permit passage of the binder 224 in a molten state into the mold cavity 208.

The binder 224 may initially be placed into the binder bowl 230 in a sold form, and then the mold assembly 200 may subsequently be placed into a furnace (not shown) to heat the entire mold assembly 200 to a predetermined infiltrating temperature to cause the binder 224 to melt and flow through the apertures 234 into the mold cavity 208 where the binder infiltrates the metal-matrix component 220. Once the metal-matrix component 220 is infiltrated, the mold assembly 200 may be removed from the furnace and permitted to cool. As the infiltrated metal-matrix component 220 cools to form the metal-matrix composite 132 (FIG. 3), the metal-matrix composite 132 solidifies around the pre-diffused mandrel 110 to form a bond therewith at the bonding location 130 (FIG. 3).

The strength of the bond formed may be influenced by metal (e.g., iron) from the mandrel 110 diffusing into the material (e.g., copper) of the binder 224 and reacting with the metal-matrix component 220 (e.g., tungsten carbide) to form brittle intermetallic particles. Additionally, the strength of the bond may be influenced by a mismatch between the coefficients of thermal expansion of the mandrel 110 and the metal-matrix component 220. The mandrel 110 and the metal-matrix component 220 may expand in the furnace by different amounts such that a relatively high concentration of the binder 224 is permitted to flow into a region near bonding location 130 (FIG. 3). The concentration of the binder 224 in the metal-matrix composite 132 near bonding location 130 may thus be relatively high. In some exemplary embodiments, the pre-diffused mandrel 110 may provide a modified surface to mitigate or suppress the formation of certain brittle phases or may otherwise provide enhanced strength of the bonding location 130.

FIGS. 5A through 6C are partial, cross-sectional views of example metallic mandrels 302*a* through 302*f* in various stages of a manufacturing procedure for chemically altering a surface of the mandrel and forming a drill bit component with the mandrel. The illustrated mandrels include a chemically modified surface 320, 336 thereon to provide enhanced bond-line strength between the (typically steel) mandrel and the metal-matrix material. Although coating the mandrel surface may be one step in process for chemically modifying the mandrel surface, surface modification is fundamentally different than coating since the applied material or the "diffusant" is allowed to diffuse or spread out freely into the base metal of the mandrel, and react therewith, such that there is no distinct or visually discernible boundary or interface between the base metal and the diffusant.

Figure 5C:
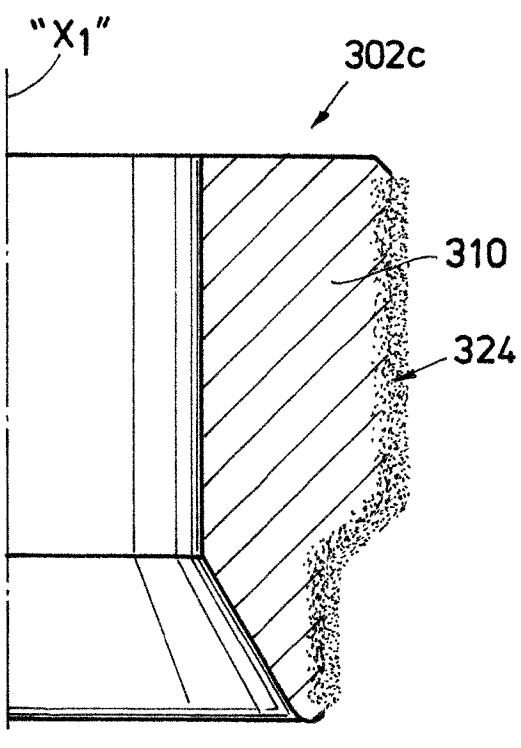
FIGS. 5A through 5C are partial, cross-sectional views of a metallic mandrel in various stages of a manufacturing procedure for chemically altering a surface of the mandrel and forming a drill bit component with the mandrel.
Figure 5B:
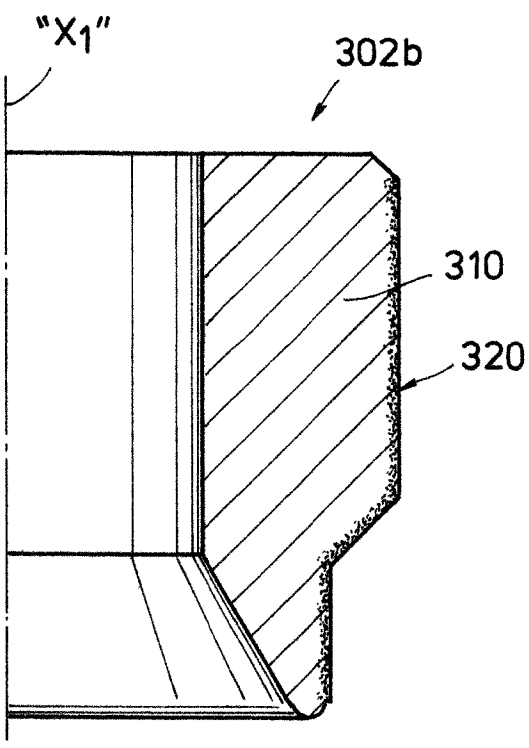
Figure 5A:
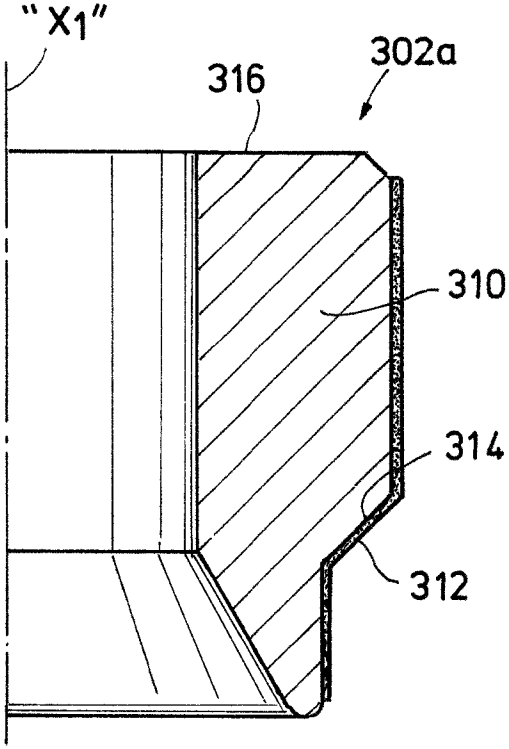

Referring to FIG. 5A, a mandrel 302*a* (illustrated in partial cross section about a longitudinal axis "$X_1$") is constructed of a base material 310. A coating of a diffusant 312 is applied to the base material 310. In some exemplary embodiments, the base material 310 may include steel alloys such as low-carbon steel, and the diffusant 312 may include materials such as carbon, nitrogen, boron, beryllium, sulfur, silicon, thorium, titanium, yttrium, zirconium, or another material that forms a eutectic melt with iron in the steel of the base material 310. Alternate diffusant 312 materials may include elements that alter the surface energy (wettability) of the base material 310 or that alloy with the base material 310 to form a low-melting phase, such as a peritectic phase. In one or more exemplary embodiments, the diffusant 312 may include reinforcing particles formed of any of the materials described above for the metal-matrix component 220. The diffusant 312 is coated on at least a portion of a bond area 314 defined on the mandrel 302*a*. In some exemplary embodiments, the mandrel 302*a* is coated on all exterior surfaces thereof or only in strategic locations. For example, an un-coated region 316 of the mandrel 302*a* may be masked, and the diffusant 312 may be applied by any recognized coating process including, e.g., sputter coating, thermal spray, plating, chemical vapor deposition, plasma vapor deposition, etc. In some other exemplary embodiments, only outer radial surfaces, all outer surfaces except a top annular surface, and/or only a bottom half (e.g., up to the top of the outer bevel) may be coated with the diffusant 312.

Once the mandrel 302*a* is coated with the diffusant 312, and prior to being loaded into a mold assembly 200 (FIG. 4), the mandrel 302*a* may be subject to a pre-load thermal process (a high-temperature process and environment) to chemically alter a surface composition of mandrel 302*a*. As illustrated in FIG. 5B, a pre-diffused mandrel 302*b* with chemically modified surface 320 may be formed by the pre-load thermal process. The diffusant 312 may simply diffuse into the base material 310, or the diffusant 312 may react with the base material 310 to form an alloy or intermetallic in the chemically modified surface 320. In some exemplary embodiments, the pre-load thermal process may include heating the mandrel 302*a* in a furnace to a predetermined processing temperature above about 2000° F. In some exemplary embodiments, the predetermined processing temperature may be in the range of about 2180° F. to about 2220° F., and in some exemplary embodiments the predetermined processing temperature may be about 2200° F. The pre-diffused mandrel 302*b* may be permitted to cool, and may then be loaded into a mold assembly 200 (FIG. 4) for bonding with matrix bit body 102 (FIG. 3) by infiltrating a metal-matrix component 220 (FIG. 4) with a binder 224 (FIG. 4) as described above.

Due to the chemically modified surface 320 of the pre-diffused mandrel 302*b*, a reduction in the formation of brittle intermetallic particles in the metal-matrix composite 132 near bonding location 130 may be realized. The chemically modified surface 320 may mitigate or reduce the formation of brittle intermetallic particles since the diffusant 312 (FIG. 5A) has had an opportunity to react with the base material 310 (FIG. 5A), and may therefore react with binder 224 (FIG. 4) to a lesser extent during the infiltration process. In contrast, if the coated mandrel 302*a* were subjected to the infiltration process, the diffusant 312 would more quickly react with the binder 224 than the base material 310, disallowing diffusion of the diffusant 312 into the base material.

In some exemplary embodiments, the applied diffusant 312 may be thick enough (on being originally applied) so that the final outer composition of the chemically modified surface 320 still resembles that of the applied diffusant 312 (see, e.g., FIG. 5B). In one or more other embodiments, the applied diffusant 312 may be sufficiently thin that the diffusant 312 becomes a minor alloying addition to the original composition of the mandrel base material 310. In some exemplary embodiments, thicknesses of the chemically modified surfaces 320 that are enriched in the applied diffusant 312 may range from about 10 μm up to 2.5 mm, depending on the original compositions of the mandrel base material 310 and the applied diffusant 312, in addition to the desired final composition of the chemically modified surface 320.

As illustrated in FIG. 5C, a bond 324 is illustrated on a bonded mandrel 302*c* subsequent to being loaded into a mold assembly 200 and subject to an infiltration process as described above. The bond 324 may be defined as a product of reaction or diffusion of the base material 310, the diffusant 312 (FIG. 5A), the binder 224 (FIG. 4) and/or the metal-matrix component 220 (FIG. 4). The bond 324 may extend radially into the bonded mandrel 302*c* and radially into the metal-matrix composite 132 formed by the infiltration process. Due to the inter-diffusion and inter-reaction between various materials, the exact boundaries of the bond 324 may not be readily discernible. The modified surface composition of the pre-diffused mandrel 302*b* may react with or diffuse into the binder 224 such that the bond 324 produced is a chemical bond and/or a functionally graded material.

Figure 6C:
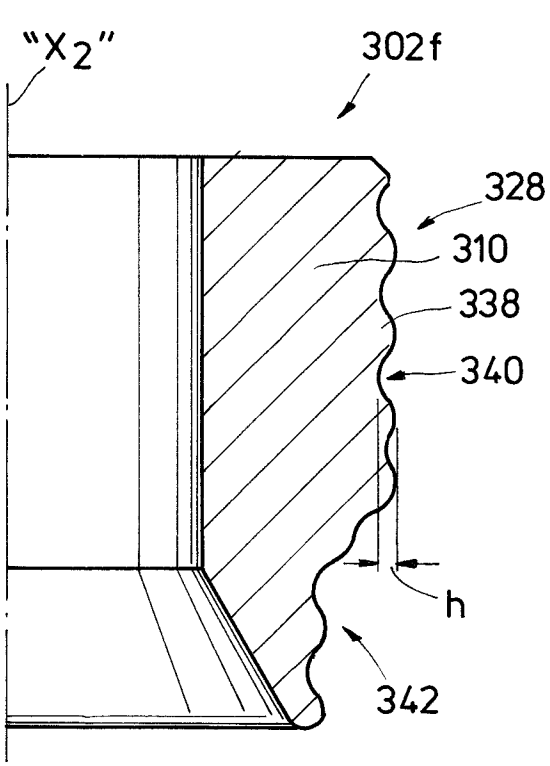
FIGS. 6A through 6C are partial, cross-sectional views of an alternate embodiment of a metallic mandrel in various stages of a manufacturing procedure for chemically altering a surface of the mandrel to create macroscopically varying surface features for mechanically interlocking with a matrix bit body.
Figure 6B:
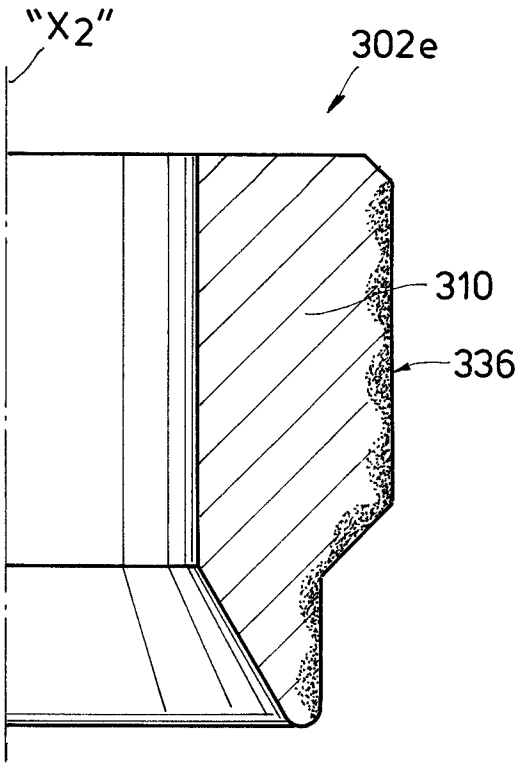
Figure 6A:
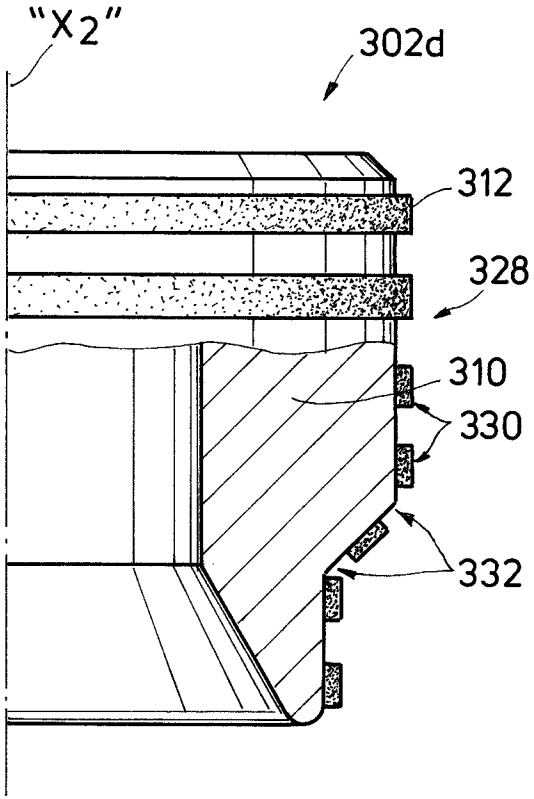

Referring now to FIGS. 6A through 6C, some exemplary embodiments of a metallic mandrel 302*d*-302*f* are illustrated in various stages of a manufacturing procedure for chemically altering a surface 336 of the mandrel to create macroscopically varying surface features 338, 340 for at least partially mechanically interlocking with a matrix bit body 102 (FIG. 2). In some embodiments, a chemically modified surface of a mandrel may facilitate mechanical interlocking of the matrix bit body 102 in addition to forming an enhanced chemical bond between the matrix bit body 102 and the mandrel.

As illustrated in FIG. 6A, in some exemplary embodiments, a diffusant 312 may be applied to the base material 310 of a mandrel 302*d* in a non-continuous pattern along a bonding location 328. Radial bands 330 of the diffusant 312 are interspaced by gaps 332 therebetween. In one or more embodiments, these bands 330 may define generally parallel rings longitudinally spaced along a longitudinal axis "$X_2$" of the mandrel 302*d*. In some other exemplary embodiments, the bands 330 may define a helical pattern similar in shape to acme threads. In some embodiments (not shown) bands may be oriented in an axial direction. In such configurations, the diffusant 312 may produce a chemically altered surface 336 having a variable radial depth in a pre-diffused mandrel 302*e* as illustrated in FIG. 6B. In some embodiments, at least one element of the chemically altered surface 336 may react with the infiltrating binder 224 (FIG. 4) to eat into the mandrel 302*e* through significant reaction and/or diffusion in localized areas or regions (e.g., where the bands 330 of diffusant 312 were applied), thereby creating an undulating or wavy bond line with macroscopically varying surfaces 342, rather than generally straight lines along an outer profile of the bonding location 328. As illustrated in FIG. 6C, macroscopic protrusions 338 and/or indentations 340 may be formed in the mandrel 302*f*. In some exemplary embodiments, a height "h" of the macroscopic protrusions 338 with respect to adjacent indentations 340 may be 25 μm or more.

The macroscopically varying surfaces 342 as illustrated in FIG. 6C may represent stark or discernible boundaries between materials of the mandrel 302*f* and the matrix bit body 102 (FIG. 2) in some embodiments. In some other embodiments, the macroscopically varying surfaces 342 may designate a key composition (e.g., 50% each of the base material 310 and binder 224 compositions) in a functionally graded bond. In any event, the macroscopically varying surfaces 342 permit the metal-matrix composite 132 (FIG. 3) to fill in the indentations 340, and thereby mechanically interlock the mandrel 302*f* and metal-matrix composite 132.

Figure 7A:
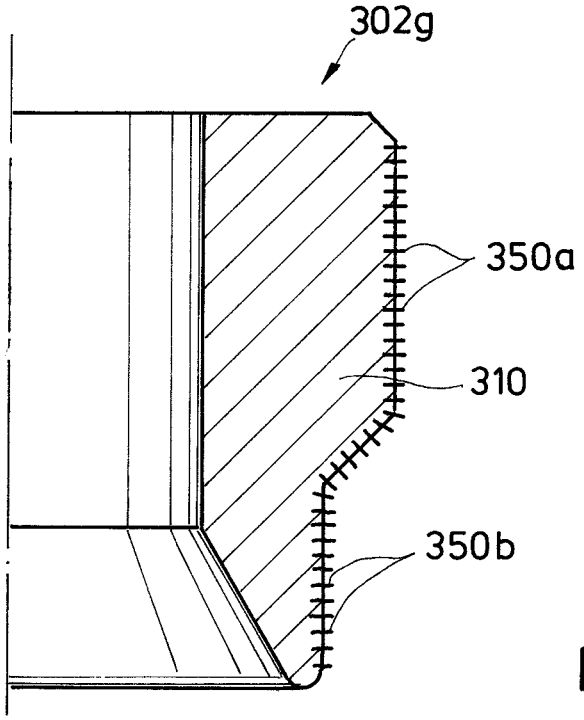
FIGS. 7A through 7D are partial, cross-sectional views of alternate embodiments of metallic mandrels including, respectively, implanted particles, machined surface features, a porous chemically altered surface and multiple diffusant layers.
Figure 7B:
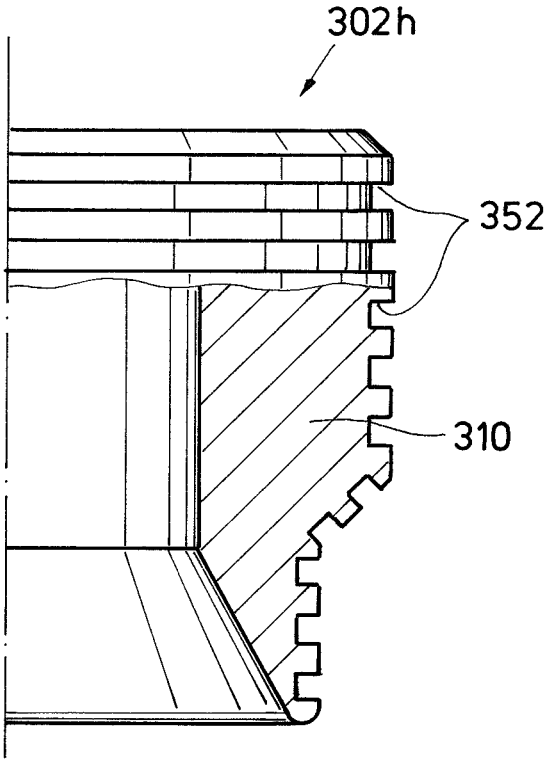
Figure 7C:
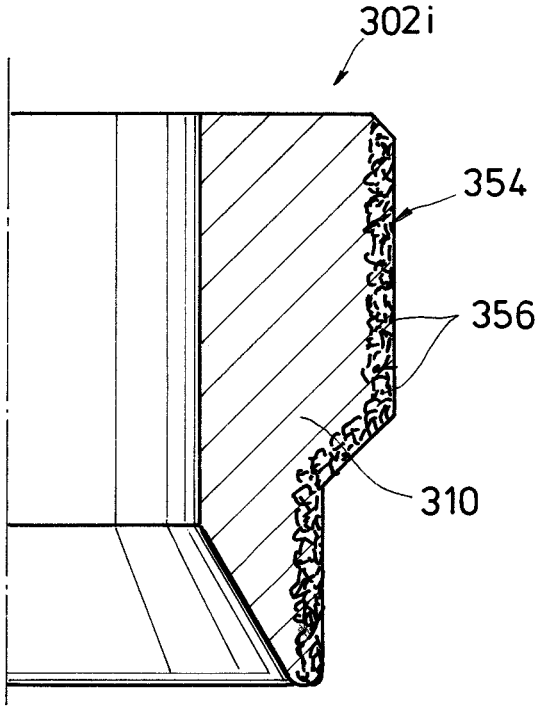
Figure 7D:
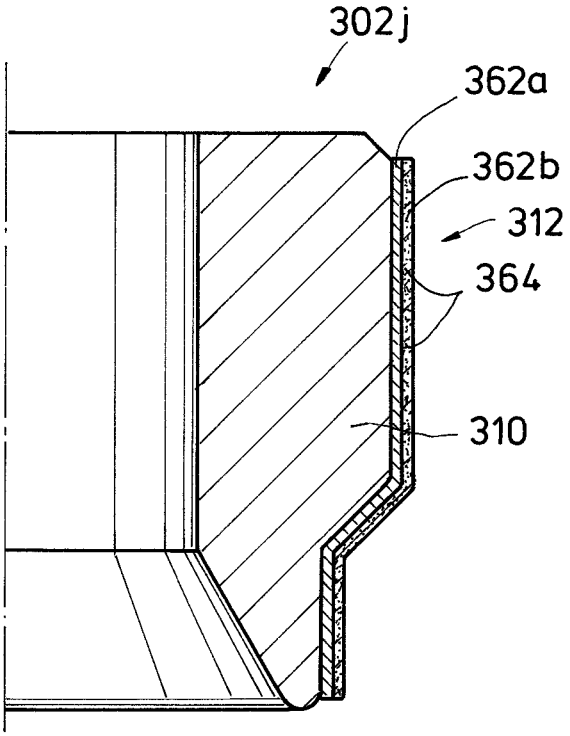

FIGS. 7A through 7D are partial, cross-sectional views of alternate embodiments of metallic mandrels 302*g* through 302*j* including, respectively, implanted particles 350*a*, 350*b* (FIG. 7A) machined surface features 352 (FIG. 7B), a porous chemically altered surface 354 (FIG. 7C) and multiple diffusant layers 362*a*, 362*b* (FIG. 7D). Referring to FIG. 7A, in some exemplary embodiments, one form of mechanical interlocking may be achieved by implanting particles 350*a* into an outer surface of a mandrel 302*g* that would increase a surface area of the mandrel 302*g*. The particles 350*a* could be constructed of a material having a higher melting temperature than the infiltrating temperature for melting the binder 224 (FIG. 4) such that the particles 350*a* do not melt when in contact with molten binder 224 during an infiltration procedure. In some exemplary embodiments, the particles 350*a* may include tungsten carbide, and or reinforcing particles of the metal-matrix component 220 (FIG. 4). Alternatively or additionally, in some exemplary embodiments, the particles 350*a* may include particles in any suitable shape including whiskers, fibers, or other suitable shapes of a refractory material that may include a carbide, nitride, oxide, boride, silicide, or refractory metal or alloy. The particles 350*a* may be implanted before or after applying a diffusant 312 (FIG. 5A), or at any point in a manufacturing procedure prior loading the mandrel 302*g* into a mold assembly 200 (FIG. 4) for an infiltration process. The particles 350*a* may be deposited or implanted in an irregular, rough, or random fashion to provide for increased interfacial area between the mandrel 302*g* and the metal-matrix composite 132 (FIG. 3) of a bit body 102 (FIG. 3). Furthermore, particles 350*b* having a distinct material composition from the particles 350*a* may be deposited on different areas of the mandrel 302*g* to provide different localized reactions with the binder 224 and/or metal-matrix component 220 during an infiltration process.

Referring to FIG. 7B, in one or more exemplary embodiments, surface features 352 may be machined or otherwise formed into a mandrel 302*h* prior to chemically modifying the surface composition of a mandrel 302*h*, and/or prior to loading the mandrel 302*h* into a mold assembly 200 for an infiltration process. The surface features 352 may include radial grooves dimples, divots, slots, threads, recesses, channels, protrusions, perforations, nubs, fins, knurls, crenelations, castellations, and any combination of these surface features 352. The surface features 352 will facilitate mechanical interlocking with the metal-matrix composite 132 of a bit body 102 (FIG. 3).

As illustrated in FIG. 7C, in some exemplary embodiments, a chemically altered surface 354 may be produced in an outer surface of a mandrel 302*i*. The chemically altered surface 354 may be formed by a diffusant 312 (FIG. 5A) during the pre-load thermal process, and defines a porosity or sponge-like characteristic of the chemically altered surface 354. The porosity permits the infiltrating binder 224 (FIG. 4) to fill in pores 356 and create a mechanical interlocking between the mandrel 302*i* and the metal-matrix composite 132 (FIG. 3) of a bit body 102 (FIG. 3).

As illustrated in FIG. 7D, in some exemplary embodiments, multiple layers 362*a*, 362*b* of diffusant 312 may be applied to a mandrel 302*j* to chemically alter a surface composition thereof. For example, an inner layer 362*a* and an outer layer 362*b* of diffusant 312 with different material compositions may be applied to the mandrel 302*j*. In some exemplary embodiments, the material composition of the outer layer 362*b* may undergo little if any change during a pre-load thermal cycle, while the inner layer 362*a* of applied material will react with and/or diffuse into the outer layer 362*b* and the base material 310 of the mandrel 302*j*, bonding the outer layer 362*b* and base material 310 together.

Also, in one or more exemplary embodiments, any or all of the multiple layers 362*a*, 362*b* may include at least one second-phase material, such as reinforcing particles 364 therein. The reinforcing particles 364 may be comprised of the metal-matrix component 220 material (FIG. 4). The reinforcing particles 364 may then supplement the concentration of the metal-matrix component 220 in the metal-matrix composite 132 (FIG. 3) formed in the region near the mandrel 302*j*, which may otherwise form a zone rich in binder 224 (FIG. 4) during an infiltration process. The reinforcing particles 364 may thus allow for more cohesive bonding between the metal-matrix composite 132 and the mandrel 302*j*.

In one or more exemplary embodiments various diffusants 312 and or reinforcing particles 364 described herein may also be deposited in an irregular, rough, or random fashion, to provide for increased interfacial area between the metal-matrix composite 132 (FIG. 3) and a mandrel 302*j*. Furthermore, different applied material compositions or diffusants 312 and may be deposited on different areas of the mandrel 302*j* to provide different localized reactions with the binder 224 (FIG. 4) and/or metal-matrix component 220 (FIG. 4).

2. Example Methods of Manufacture and Operation

Figure 8:
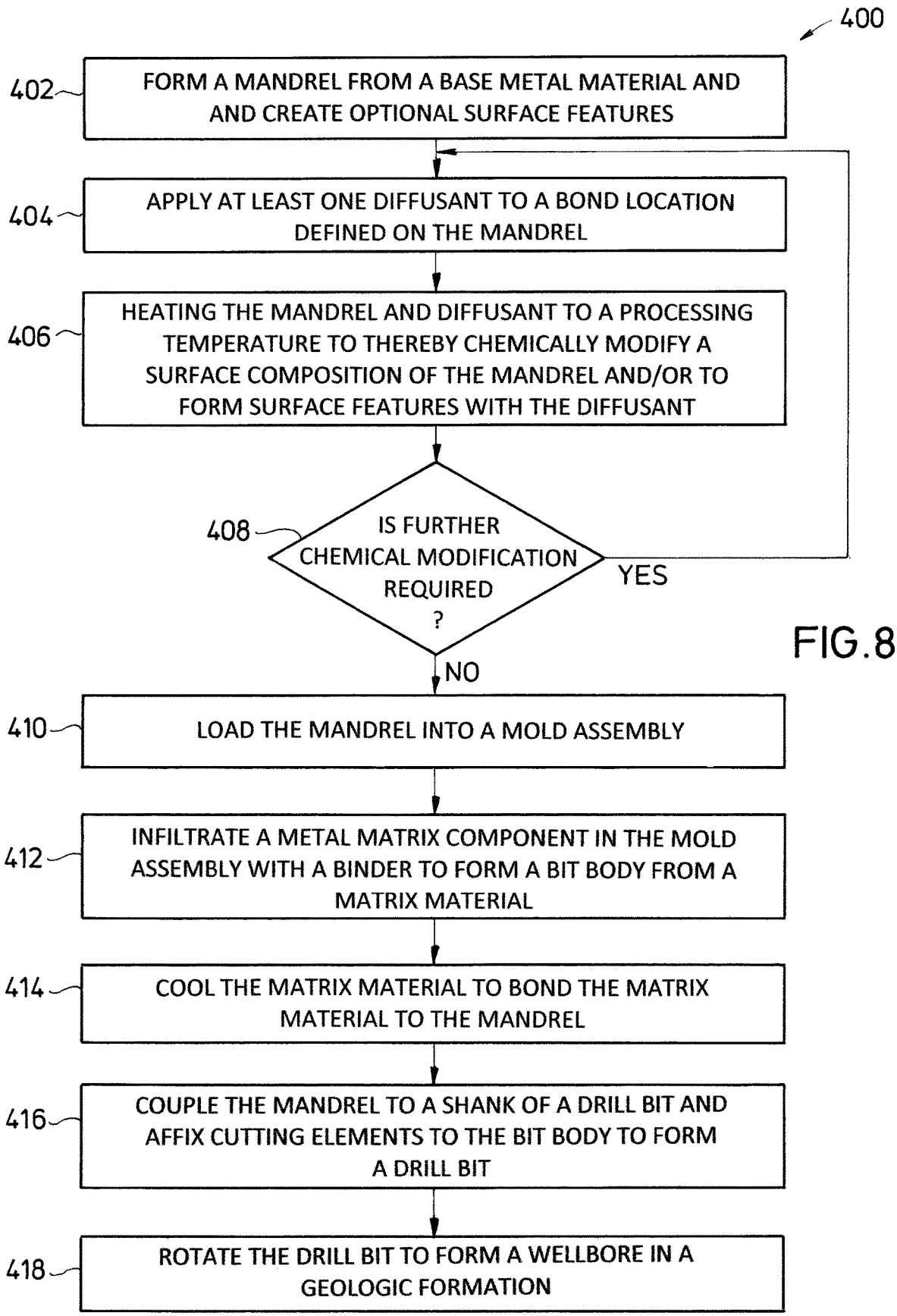
FIG. 8 is a flowchart illustrating a procedure for manufacturing and using a fixed-cutter drill bit in accordance with aspects of the present disclosure.

FIG. 8 is a flowchart illustrating a procedure 400 for manufacturing and using a fixed-cutter rotary drill bit 100 in accordance with aspects of the present disclosure. Referring to FIG. 8, and with continued reference to FIGS. 1 through 7D, the procedure 400 begins at step 402, where a mandrel 110 is constructed of a base material 310. Optional surface features 352 may be pre-machined or mechanically formed into the base material 110. Next, at step 404, at least one diffusant 312 may be applied to at least a portion of a bonding location 130 of the mandrel 110. The at least one diffusant 312 may be applied in one or more distinct layers 362*a*, 362*b* by any recognized coating process. Next a pre-load thermal process (step 406), may chemically alter a surface composition of the mandrel 110. In the pre-load thermal process, the mandrel 110 coated with the diffusant 312 may be placed in a furnace (not shown) and heated to a processing temperature to thereby chemically alter a surface composition of the mandrel 110. In one or more exemplary embodiments, chemically altering the surface composition of the mandrel 110 may include carburizing, nitriding, boronizing, diffusing, reacting, interacting, impinging, impacting, thermal spraying, welding, depositing or mechanically impacting the bonding location 130 of the mandrel 110. In some exemplary embodiments, the surface features such as protrusions 338 and indentations 340 may be formed by the diffusant during the pre-load thermal process, or similar surface features may be formed by heating the mandrel to a processing temperature sufficient to partially melt the mandrel 110.

Next at decision 408, a determination is made whether further chemical modification of the mandrel 110 is desired. If further chemical modification is desired, the procedure 400 may return to step 404 where an additional diffusant 312 may be applied to the chemically modified surface, e.g., surface 320 or another distinct region of the bonding location 130, and an additional pre-load thermal process (step 406) may be applied. If it is determined at decision 408 that no further chemical modification is desired, the procedure 400 may proceed to step 410 where the mandrel 110 may be loaded into a mold assembly 200 along with a metal-matrix component 220 or reinforcing material.

Next, an infiltration procedure may be performed (step 412) to infiltrate metal-matrix component 220 in the mold assembly with a binder 224. The infiltration procedure may include heating the binder 224 to an infiltration temperature above a melting point to permit the molten binder 224 to flow into the metal-matrix component 220. The metal-matrix composite 132 formed by the binder 224 and metal-matrix component 220 may be quenched or otherwise permitted to cool (step 414). A bond is formed thereby between the metal-matrix composite 132 and the chemically modified surface 320 as the molten binder 224 solidifies about the mandrel 110.

Once cooled, the mold assembly 200 may be removed from the bit body 102, and the rotary drill bit 100 may be completed at step 416. For example, to complete the rotary drill bit 100, the mandrel 110 may be coupled to a shank 104 of the rotary drill bit 100, and cutting elements 118 may be fastened to the bit body 102. The completed rotary drill bit 100 may then be coupled to a drill string 18 and rotated (step 418) to form a wellbore in a geologic formation "G."

3. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a method of manufacturing a drill bit component. The method includes (a) applying a first diffusant to at least a portion of a bonding location defined on a mandrel for the drill bit component, (b) chemically modifying the surface composition of the bonding location by heating the mandrel and the first diffusant to a processing temperature, (c) subsequent to chemically modifying the surface composition, infiltrating a metal-matrix component with a binder to form a matrix material, and (d) cooling the matrix material about the bonding location on the mandrel to bond the matrix material to the mandrel at the bonding location.

In some exemplary embodiments chemically modifying the surface composition of the bonding location includes forming macroscopically varying surface features for mechanically interlocking with a matrix bit body, and in some embodiments, chemically modifying the surface composition includes pre-diffusing a diffusant into the bonding location of the mandrel such that the matrix bit body bonds with pre-diffused surface. In one or more embodiments, chemically modifying the surface composition of the bonding location includes at least one of diffusing, reacting, interacting, carburizing, nitriding, boronizing, impinging, impacting, thermal spraying, welding, depositing or mechanically impacting the bonding location of the mandrel.

In one or more exemplary embodiments, the method further includes forming surface features into the bonding location prior to or subsequent to chemically modifying the surface composition. The surface features may include at least one of dimples, divots, slots, grooves, threads, recesses, channels, protrusions, perforations, nubs, fins, knurls, crenelations and castellations. In some exemplary embodiments, the surface features are formed in the mandrel prior to applying the first diffusant. In some exemplary embodiments, the surface features are formed in the mandrel by the first diffusant, e.g., by reacting or interacting with the diffusant.

In exemplary embodiments, the method further includes implanting particles into the bonding location of the mandrel. In some embodiments, the particles protrude from a base material of the mandrel to increase a surface area of the mandrel in the bonding location, and in some embodiments, the particles are constructed of a material having a higher melting temperature than an infiltrating temperature. In some exemplary embodiments, the particles are constructed of a material defining the metal-matrix component. In some exemplary embodiments, the implanted material may be in the form of particles, whiskers, fibers, or other suitable shapes of a refractory material that may include a carbide, nitride, oxide, boride, silicide, or refractory metal or alloy.

In one or more exemplary embodiments, the method further includes applying at least a second diffusant to the bonding location in an outer layer over the first diffusant, wherein the second diffusant is distinct from the first diffusant. In some exemplary embodiments, the method further includes applying at least a second diffusant to the bonding location either prior or subsequent to chemically modifying the surface composition and prior to infiltrating the metal-matrix component with the binder.

In some exemplary embodiments, applying the first diffusant comprises applying the first diffusant in a non-continuous pattern along the bonding location. In some embodiments, the non-continuous pattern includes bands of the first diffusant interspaced by gaps in the diffusant. The bands may be arranged radially in some embodiments, and in some embodiments the bands may be arranged helically, longitudinally or diagonally.

In another aspect, the present disclosure is directed to a drill bit including a mandrel constructed of a base metal and defining a bonding location thereon. A diffusant is disposed within the base metal at the bonding location such that a surface composition of the base metal is chemically altered at the boding location. A metal-matrix material bonded to the mandrel at the bonding location, the metal-matrix material comprising a metal-matrix component infiltrated with a binder.

In some exemplary embodiments, the base material of the mandrel is steel and the diffusant is at least one of carbon, nitrogen, boron, beryllium, sulfur, silicon, thorium, titanium, yttrium, and zirconium. In one or more exemplary embodiments, the bonding location further includes surface features thereon for interlocking with the metal-matrix material. In some exemplary embodiments, the surface features include a porous chemically altered surface. In one or more exemplary embodiments, the metal-matrix material defines a plurality of cutting blades supporting a plurality of cutting elements thereon.

In another aspect, the disclosure is directed to a method of manufacturing and using a drill bit. The method includes (a) applying a diffusant to at least a portion of a bonding location defined on a mandrel, (b) chemically modifying a surface composition of the bonding location with the diffusant, (c) infiltrating, subsequent to chemically modifying the surface composition, a metal-matrix component with a binder to form a matrix material, (d) bonding the composite material to the mandrel at the bonding location, and (e) coupling the mandrel to a shank for coupling the drill bit to a drill string.

In one or more exemplary embodiments, the method further includes coupling the drill bit to a drill string and rotating the drill bit to form a wellbore in a geologic formation. In one or more exemplary embodiments, chemically modifying the surface composition with the diffusant comprises heating the mandrel to a processing temperature to diffuse the diffusant into a base material of the mandrel.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A method of manufacturing a drill bit component, the method comprising:

applying a first diffusant to at least a portion of a bonding location defined on a mandrel for the drill bit component;

diffusing the first diffusant into a base metal of the mandrel to provide an indistinct boundary between the base metal and the first diffusant to chemically modify a surface composition of the bonding location by heating the mandrel and the first diffusant to a processing temperature;

infiltrating, subsequent to diffusing the first diffusant into the base metal and chemically modifying the surface composition, a matrix component with a binder to form a composite material; and cooling the composite material about the bonding location on the mandrel to bond the composite material to the mandrel at the bonding location.

2. The method of claim 1, wherein the step of chemically modifying the surface composition of the bonding location comprises at least one process selected from the group consisting of: reacting, interacting, carburizing, nitriding, boronizing, impinging, impacting, thermal spraying, welding, depositing or mechanically impacting the bonding location of the mandrel.

3. The method of claim 1, further comprising forming surface features into the bonding location prior to chemically modifying the surface composition.

4. The method of claim 3, wherein the surface features are selected from the group consisting of dimples, divots, slots, grooves, threads, recesses, channels, protrusions, perforations, nubs, fins, knurls, crenelations and castellations.

5. The method of claim 3, further comprising forming the surface features in the mandrel prior to applying the first diffusant.

6. The method of claim 3, further comprising forming the surface features in the mandrel by the first diffusant.

7. The method of claim 1, further comprising implanting particles into the bonding location of the mandrel to increase a surface area of the mandrel in the bonding location, wherein the particles are constructed of a material having a higher melting temperature than an infiltrating temperature for melting the binder.

8. The method of claim 7, wherein the particles are constructed of a material defining the metal-matrix component.

9. The method of claim 1, further comprising applying at least a second diffusant to the bonding location in an outer layer over the first diffusant, wherein the second diffusant is distinct from the first diffusant.

10. The method of claim 1, further comprising applying at least a second diffusant to the bonding location subsequent to chemically modifying the surface composition and prior to infiltrating the metal-matrix component with the binder.

11. The method of claim 1, wherein the step of applying the first diffusant comprises applying the first diffusant in a non-continuous pattern along the bonding location.

12. The method of claim 11, wherein the non-continuous pattern is selected from the group consisting of radial bands, axial bands and threaded bands of the first diffusant interspaced by gaps in the first diffusant.

13. A drill bit component, comprising:

a mandrel constructed of a base metal and defining a bonding location thereon;

a diffusant disposed within the base metal at the bonding location such that an indistinct boundary is defined between the diffusant and the base metal within the mandrel and a surface composition of the base metal is chemically altered at the boding location; and a metal-matrix composite bonded to the mandrel at the bonding location, the metal-matrix composite comprising a metal-matrix component infiltrated with a binder.

14. The drill bit component of claim 13, wherein the base metal of the mandrel is steel and the diffusant includes a material selected from the group consisting of carbon, nitrogen, boron, beryllium, sulfur, silicon, thorium, titanium, yttrium, and zirconium.

15. The drill bit component of claim 13, wherein the bonding location further includes surface features thereon for interlocking with the metal-matrix composite.

16. The drill bit component of claim 15, wherein the surface features include a porous chemically altered surface.

17. The drill bit component of claim 13, wherein the metal-matrix composite defines a plurality of cutting blades supporting a plurality of cutting elements thereon.

18. A method comprising:

applying a diffusant to at least a portion of a bonding location defined on a mandrel;

diffusing the diffusant into a base material of the mandrel to provide an indistinct boundary between the base material and the diffusant;

to chemically modify a surface composition of the bonding location with the diffusant;

infiltrating, subsequent to diffusing the first diffusant into the base material and chemically modifying the surface composition, a metal-matrix component with a binder to form a matrix composite;

bonding the matrix composite to the mandrel at the bonding location; and coupling the mandrel to a shank.

19. The method of claim 18, wherein the step of chemically modifying the surface composition with the diffusant comprises heating the mandrel to a processing temperature to diffuse the diffusant into the base material of the mandrel.

* * * * *